US012538950B2

(12) United States Patent
Harrington et al.

(10) Patent No.: US 12,538,950 B2
(45) Date of Patent: Feb. 3, 2026

(54) FACEMASKS AND METHOD FOR MANUFACTURING THE SAME

(71) Applicant: O&M Halyard, Inc., Mechanicsville, VA (US)

(72) Inventors: David L. Harrington, Cumming, GA (US); Eric C. Steindorf, Roswell, GA (US); Anthony Stephen Spencer, Woodstock, GA (US); Joseph P. Weber, Suwanee, GA (US); Mark T. Pamperin, Cumming, GA (US)

(73) Assignee: O&M Halyard, Inc., Glen Allen, VA (US)

( * ) Notice: Subject to any disclaimer, the term of this patent is extended or adjusted under 35 U.S.C. 154(b) by 816 days.

(21) Appl. No.: 17/043,065

(22) PCT Filed: Apr. 13, 2018

(86) PCT No.: PCT/US2018/027500
§ 371 (c)(1),
(2) Date: Sep. 29, 2020

(87) PCT Pub. No.: WO2019/199319
PCT Pub. Date: Oct. 17, 2019

(65) Prior Publication Data

US 2021/0030085 A1 Feb. 4, 2021

(51) Int. Cl.
*A41D 13/11* (2006.01)

(52) U.S. Cl.
CPC ..... *A41D 13/1107* (2013.01)

(58) Field of Classification Search
CPC A41D 13/1107; A41D 13/1161; A41D 13/11; A62B 23/025
See application file for complete search history.

(56) References Cited

U.S. PATENT DOCUMENTS 2,751,905 A * 6/1956 Creelman ..... A41D 13/11 128/206.19
2,905,173 A * 9/1959 Wold ..... A41D 13/11 128/207.11

(Continued)

FOREIGN PATENT DOCUMENTS

CN 2067586 U 12/1990
CN 202211186 U 5/2012

(Continued)

OTHER PUBLICATIONS

International Search Report and Written Opinion for PCT/US2018/027500, dated Dec. 10, 2018, 12 pages.

*Primary Examiner* — Alissa L Hoey
(74) *Attorney, Agent, or Firm* — Dority & Manning, P.A.

(57) ABSTRACT

A facemask and automated system for producing facemasks is disclosed. The facemask has a longitudinal direction and a lateral direction that is perpendicular to the longitudinal direction. The facemask includes a mask body having a generally rectangular shape, a pair of lateral edges extending in the lateral direction, and a pair of longitudinal edges extending in the longitudinal direction. At least one tie is attached to the mask body such that the tie extends away from the mask body in a direction that forms an angle with the longitudinal direction. The angle ranges from about 10 degrees to about 80 degrees.

11 Claims, 11 Drawing Sheets

(56) References Cited

U.S. PATENT DOCUMENTS 3,500,825 A * 3/1970 Arne ..... A41D 13/11 128/206.19
4,312,338 A * 1/1982 Glassman ..... A41D 13/11 128/201.12
4,867,148 A * 9/1989 Gomez ..... A61M 16/106 128/202.28
4,974,605 A * 12/1990 Esqueda ..... A61F 6/04 128/857
5,016,649 A * 5/1991 Johnson ..... A61F 6/04 128/857
5,025,506 A * 6/1991 Huang ..... A41D 13/11 128/206.16
5,107,547 A 4/1992 Scheu
5,424,787 A * 6/1995 Zegarelli ..... A61F 9/029 351/158
5,446,925 A * 9/1995 Baker ..... A61F 9/02 2/9
5,558,089 A * 9/1996 Castiglione ..... A41D 13/1161 128/203.29
5,636,628 A * 6/1997 Barnum ..... A41D 13/1192 128/206.19
D388,514 S * 12/1997 Johnson ..... D24/105
5,803,077 A 9/1998 Gazzara
5,891,508 A 4/1999 Barnum
6,332,465 B1 * 12/2001 Xue ..... A41D 13/1146 128/206.28
6,354,296 B1 * 3/2002 Baumann ..... A41D 13/1115 128/206.25
D511,209 S * 11/2005 Callan ..... D24/110.1
7,044,131 B2 * 5/2006 Griesbach, III ... A41D 13/1161 128/207.11
7,762,257 B2 7/2010 Chiam
7,766,015 B2 * 8/2010 Harold ..... A41D 13/1161 128/201.17
7,802,572 B2 * 9/2010 Hahne ..... A41D 13/1192 128/857
8,091,550 B2 * 1/2012 Steindorf ..... A41D 13/11 128/206.16
8,695,603 B2 * 4/2014 Harold ..... A41D 13/11 128/206.28
9,032,955 B2 5/2015 Lubke et al.
D849,928 S * 5/2019 Grover ..... D24/110.1
10,653,901 B2 5/2020 Nguyen et al.
10,946,999 B2 * 3/2021 Steindorf ..... A41D 13/1115
11,083,916 B2 * 8/2021 Duffy ..... A41D 13/1115
11,116,998 B2 * 9/2021 Duffy ..... A62B 23/025
D950,707 S * 5/2022 Coates ..... D29/108
11,457,677 B2 * 10/2022 Sun ..... A41D 13/1161
2004/0000313 A1 * 1/2004 Gaynor ..... B01D 39/1623 128/205.27
2005/0133036 A1 * 6/2005 Steindorf ..... A41D 13/11 128/206.13
2006/0283454 A1 * 12/2006 Delaney ..... A41D 13/1161 128/206.28
2010/0224199 A1 * 9/2010 Smith ..... A61M 16/06 128/863
2012/0325221 A1 * 12/2012 Tran ..... A62B 23/025 128/206.17
2015/0238783 A1 8/2015 Nguyen et al.
2016/0151650 A1 * 6/2016 Reese ..... A41D 13/1161 128/863
2017/0157435 A1 6/2017 Choi
2017/0367417 A1 * 12/2017 Takashina ..... A44B 99/00
2018/0160749 A1 * 6/2018 Kim ..... A41D 13/1107
2020/0008970 A1 * 1/2020 Parker ..... A41D 31/00
2020/0298032 A1 * 9/2020 Torbenson ..... A62B 18/025
2021/0298375 A1 * 9/2021 Snoke ..... A41D 13/1115
2021/0345702 A1 * 11/2021 Volk ..... A41D 13/11
2021/0345705 A1 * 11/2021 Smith ..... A41D 13/1161
2022/0143349 A1 * 5/2022 Yoder ..... A61M 16/0616
2023/0157389 A1 * 5/2023 Nishigawa ..... B63C 11/12 128/863

FOREIGN PATENT DOCUMENTS

CN 202950037 U 5/2013
CN 204861307 U 12/2015
CN 205093629 U 3/2016
FR 1268021 A 7/1961
WO WO 98/54991 A1 12/1998
WO WO 2014/122790 A1 8/2014
WO WO 2017/111783 A1 6/2017

* cited by examiner

FACEMASKS AND METHOD FOR MANUFACTURING THE SAME

RELATED APPLICATION

The present application is the national stage entry of and claims priority to International Patent Application No. PCT/US2018/027500 having a filing date of Apr. 13, 2018, the contents of which are incorporated herein by reference thereto.

FIELD OF THE INVENTION

The present invention relates generally to the field of protective facemasks, such as surgical facemasks, and more specifically to a method and system for manufacturing facemasks a production line.

BACKGROUND OF THE INVENTION

Various configurations of disposable filtering facemasks or respirators are known and may be referred to by various names, including "facemasks", "respirators", "filtering face respirators", "surgical facemasks", and so forth. For purposes of this disclosure, such devices are referred to herein generically as "facemasks."

The ability to supply aid workers, rescue personnel, and the general populace with protective facemasks during times of natural disasters or other catastrophic events is crucial. For example, in the event of a pandemic, the use of facemasks that offer filtered breathing is a key aspect of the response and recovery to such event. For this reason, governments and other municipalities generally maintain a ready stockpile of the facemasks for immediate emergency use. However, the facemasks have a defined shelf life, and the stockpile must be continuously monitored for expiration and replenishing. This is an extremely expensive undertaking.

Recently, investigation has been initiated into whether or not it would be feasible to mass produce facemasks on an "as needed" basis during pandemics or other disasters instead of relying on stockpiles. For example, in 2013, the Biomedical Advanced Research and Development Authority (BARDA) within the Office of the Assistant Secretary for Preparedness and Response in the U.S. Department of Health and Human Services estimated that up to 100 million facemasks would be needed during a pandemic situation in the U.S., and proposed research into whether this demand could be met by mass production of from 1.5 to 2 million facemasks per day to avoid stockpiling. This translates to about 1,500 facemasks per minute. Current facemask production lines are capable of producing only about 100 facemasks per minute due to technology and equipment restraints, which falls far short of the estimated goal. Accordingly, advancements in the manufacturing and production processes will be needed if the goal of "on demand" facemasks during a pandemic is to become a reality.

Certain configurations of pleated facemasks include head fastening ties bonded to opposite edges of a rectangular body. Forming the rectangular bodies and attaching the ties may include cutting the web into the rectangular bodies, rotating the rectangular bodies, and then attaching the ties. For example, a web of textile material may be conveyed in a machine direction and pleats or folds may be formed extending in the machine direction. The web may then be cut at regular intervals along the cross-machine direction to form rectangular bodies. Each rectangular body may then be rotated 90 degrees with respect to the machine direction, and the ties may then be attached to the rectangular bodies along the edges of the rectangular bodies with respect to the machine direction. Rotating the rectangular bodies and attaching the ties using the current manual and automated methods for manufacturing, however, is relatively slow. For mass production of facemasks at the throughputs mentioned above, it would be desirable to form the rectangular bodies and attach the ties while maintaining the high production speeds of the running line.

Additionally, the configuration described above may create elevated stresses where the ties attach to the rectangular body, which can increase the risk of failure at such locations. More specifically, during use, the ties are wrapped around the crown of the head of the user. This can pull the ties at angles that are not perpendicular to any edge of the facemask, causing increased tension and stress in the ties and or rectangular body near where they are attached to each other.

The present invention addresses this need and provides a robust facemask that is better suited for high speed manufacturing as well as a manufacturing method thereof.

SUMMARY OF THE INVENTION

Objects and advantages of the invention will be set forth in the following description, or may be obvious from the description, or may be learned through practice of the invention.

In accordance with aspects of the invention, a facemask has a longitudinal direction and a lateral direction that is perpendicular to the longitudinal direction. The facemask includes a mask body having a generally rectangular shape, a pair of lateral edges extending in the lateral direction, and a pair of longitudinal edges extending in the longitudinal direction. At least one tie is attached to the mask body and extends away from the mask body in a direction that forms an angle with the longitudinal direction which ranges from about 10 degrees to about 80 degrees.

In a particular embodiment, the pair of lateral edges are free of any ties along a substantial portion of a length of the lateral edges.

In another particular embodiment, the pair of longitudinal edges are free of any ties along a substantial portion of a length of the longitudinal edges.

In another particular embodiment, the pair of lateral edges are free of any ties along a substantial portion of a length of the lateral edges, and the pair of longitudinal edges are free of any ties along a substantial portion of a length of the longitudinal edges.

In another particular embodiment, the mask body has a pair of upper corners. The facemask includes a pair of upper ties each having an attached end and a free end. The attached end of each upper tie is attached to the mask body adjacent a respective one of the pair of upper corners. Each of the pair of upper ties extends away from the mask body in a direction that forms an upper tie angle with the longitudinal direction, and the upper tie angle ranges from about 10 degrees to about 80 degrees.

In another particular embodiment, the mask body has a pair of lower corners. The facemask includes a pair of lower ties that are separate from the pair of upper ties. Each of the pair of lower ties has an attached end and a free end. The attached end of each lower tie attached to the mask body adjacent a respective one of the pair of lower corners. Each of the pair of lower ties extends away from the mask body in a lower tie direction that forms a lower tie angle with the longitudinal direction. The lower tie angle ranges from about 10 degrees to about 80 degrees.

In another particular embodiment, the facemask includes a single tie having a first free end, a second free end, and a middle portion therebetween. The middle portion is attached along one of the longitudinal edges of the mask body.

In another particular embodiment, the angle is selected such that at least one tie extends approximately in a tension direction along which the at least one tie is pulled when worn.

In another particular embodiment, at least one tie is ultrasonically bonded to the mask body.

In another particular embodiment, the mask body has a pair of upper corners. The facemask includes an upper tie having a first free end, a second free end, and a middle portion therebetween. The middle portion is attached along the upper longitudinal edge between the pair of upper corners. The upper tie comprises a pair of folds adjacent each of the pair of upper corners such that the first and second free ends extend away from the mask body in directions that form upper tie angles with the longitudinal direction. Each upper tie angle ranges from about 10 degrees to about 80 degrees.

In another particular embodiment, the mask body has a pair of upper corners and a pair of lower corners. The facemask includes a lateral tie having a first free end, a second free end, and a middle portion therebetween. The middle portion is attached along one of the lateral edges between one of the pair of upper corners and one of the pair of lower corners. The lateral tie includes a pair of folds. One of the pair of folds is adjacent one of the pair of upper corners, and the other of the pair of folds is adjacent one of the pair of lower corners. The first and second free ends of the lateral tie extend away from the mask body in directions that form upper and lower tie angles with the longitudinal direction. The upper and lower tie angles range from about 10 degrees to about 80 degrees.

In accordance with other aspects of the invention, an automated method is provided for manufacturing facemasks from a web material of a textile product in a production line. The method includes conveying the web material of the textile product in the production line along a machine direction. The method includes cutting, at a cutting station, the web material along a cutting line extending in a cross-machine direction that is perpendicular to the machine direction. The method includes attaching, at a tie attaching station, at least one tie to the web material at a location adjacent the cutting line such that the at least one tie extends in a direction that forms an angle with the cutting line. The angle ranges from about 10 degrees to about 80 degrees.

In a particular embodiment, the web material is cut at the cutting station before the tie is attached to the web material at the tie attaching station. In another particular embodiment, the tie is attached to the web material at the tie attaching station before the web material is cut at the cutting station.

In another particular embodiment, the method includes attaching a pair of upper ties to the web material such that the upper ties extend from the web material in respective directions that form respective upper tie angles with the cutting line. Each upper tie angle ranges from about 10 degrees and about 80 degrees.

In another particular embodiment, the method includes attaching a pair of lower ties to the web material such that the lower ties extend from the web material in respective directions that form respective lower tie angles with the cutting line. Each lower tie angle ranges from about 10 degrees and about 80 degrees.

In another particular embodiment, cutting the web material includes forming a separate mask body from the web material. The method further includes attaching a tie to the separate mask body such that the tie extends beyond each of a first lateral edge and a second lateral edge of the separate mask body.

In another particular embodiment, the method includes attaching the at least one tie to the web such that the at least one tie extends beyond each of a first lateral edge and a second lateral edge of the separate mask body. The method further includes folding the tie such that a first free end and a second free end of the tie extend away from the web in respective directions that form respective tie angles with the cutting line. Each tie angle ranges from about 10 degrees and about 80 degrees.

In another particular embodiment, the method includes attaching a middle portion of a lateral tie to the mask body adjacent a lateral edge of the mask body. In some embodiments, the method includes folding the lateral tie adjacent each of an upper corner and a lower corner such that each of a first free end and a second free end of the lateral tie extend away from the mask body in respective directions that form respective lateral tie angles with the cutting line, wherein the lateral tie angles range from about 10 degrees and about 80 degrees.

In another particular embodiment, the method includes alternately producing at least two different types of facemasks on a single production line system.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
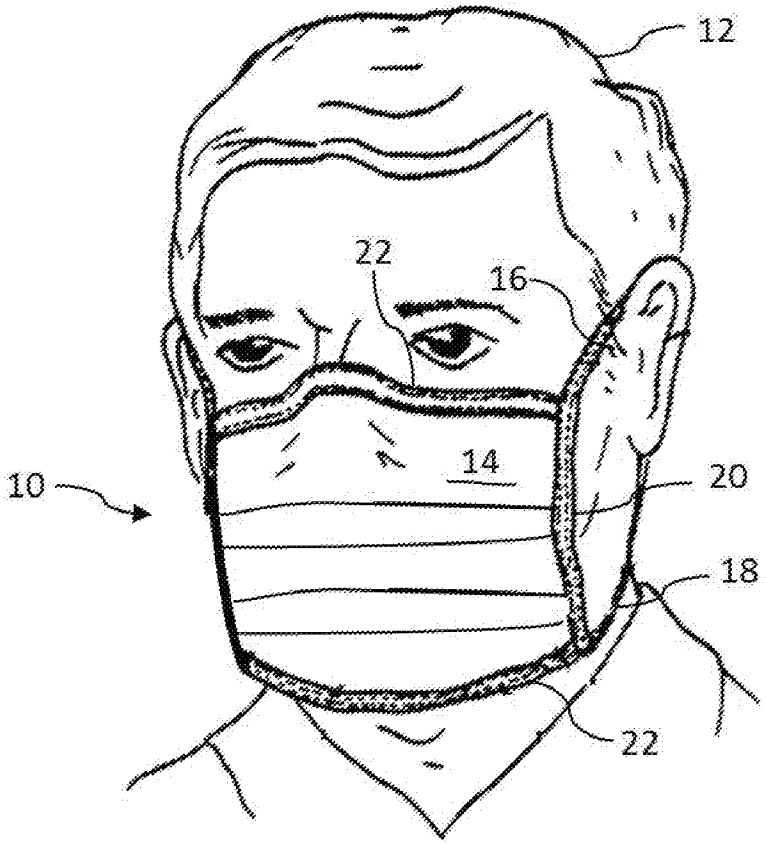
FIG. 1 PRIOR ART
FIG. 1 is a perspective view of a conventional facemask worn by a user, the facemask incorporating upper and lower head fastening ties.

Repeat use of reference characters in the present specification and drawings is intended to represent the same or analogous features or elements of the present invention.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents. For the purposes of this application, like features will be represented by like numbers between the figures.

Generally speaking, the present disclosure is directed to a facemask and method for producing a facemask. The facemask may include upper and/or lower ties that are attached such that they form an angle between about 10 degrees and about 80 degrees with a longitudinal direction of the facemask. When the facemask is worn, the ties may be pulled tight by the head of the wearer. The ties may extend from a mask body of the facemask such that the ties are approximately aligned with a direction in which they are pulled during use, e.g., in a "tension direction". For example, the ties may extend away from the mask body in a direction that forms an angle with a longitudinal direction, and that angle may range from about 10 degrees to about 80 degrees, in some embodiments from about 20 degrees to about 60 degrees, and in some embodiments from about 30 degrees to about 50 degrees, e.g., about 45 degrees. Such a configuration may reduce stress where the ties are attached to the mask body and improve the durability of the facemask. Additionally, folding and/or rippling of the mask body and/or ties may be reduced resulting in a more comfortable and/or aesthetically pleasing facemask.

The mask body of the facemask may be formed from a variety of suitable textile products. For purposes of this invention, the term "textile product" includes a web that has a structure of individual fibers or threads which are interlaid, but not in an identifiable, repeating manner—commonly referred to as a "nonwoven web". Nonwoven webs have been, in the past, formed by a variety of processes such as, for example, meltblowing processes, spunbonding processes, and bonded carded web processes. The term "meltblown fibers" means fibers formed by extruding a molten thermoplastic material through a plurality of fine, usually circular, die capillaries as molten threads or filaments into a high velocity gas (e.g. air) stream which attenuates the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. The term "spunbonded fibers" refers to small diameter fibers which are formed by extruding a molten thermoplastic material as filaments from a plurality of fine, usually circular, capillaries of a spinnerette with the diameter of the extruded filaments then being rapidly reduced as by, for example, eductive drawing or other well-known spunbonding mechanisms. The term "textile product" may also include fabrics formed using any suitable technique, however.

Additionally, "textile product" may refer to a variety of suitable materials, including, for example, polypropylene, polyethylene, or polyester. These materials may include, for example, fiber-grade spunbond polypropylene (SBPP), fiber-grade melt-blown polypropylene (MBPP), and low density polyethylene (LDPE). Any suitable material, however, may be used to form a facemask in accordance with aspects of the present disclosure.

In accordance with aspects of the present disclosure, a method of making facemasks may include conveying the web material of the textile product in the production line along a machine direction. The method may include cutting, at a cutting station, the web material along a cutting line extending in a cross-machine direction that is perpendicular to the machine direction. The method may also include attaching, at a tie attaching station, at least one tie to the web material at a location adjacent the cutting line such that the at least one upper tie extends in a direction that forms an angle with the cutting line, wherein the angle ranges from about 10 degrees to about 80 degrees.

A single production line system may be configured to produce a variety of facemask types, as described in greater detail below. For example, four separate ties may be attached to respective corners of the mask body. Alternatively, a single lower tie may be attached along a lower longitudinal edge of the mask body and optionally folded such that free ends of the single lower tie extends at an angle that ranges from about 10 degrees to about 80 degrees with the longitudinal direction. Other facemask embodiments are described in greater detail below. Regardless, in some embodiments, a single production line system may be configured to switch between various facemask types with minimal or no downtime required (e.g., to adjust settings of the system). For example, in some embodiments, a single production line may be configured to produce two or more different types of facemasks in alternation.

Figure 2A:
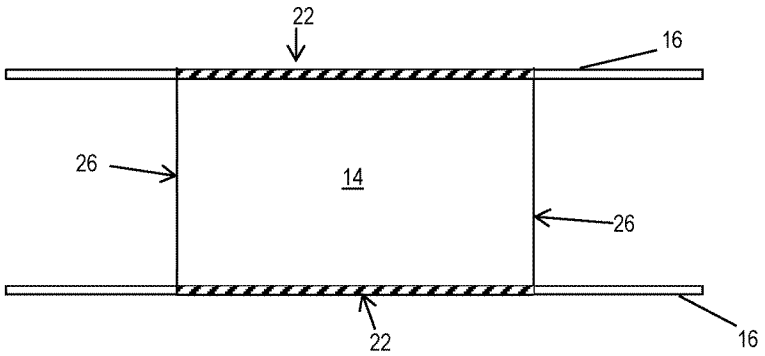
FIG. 2A (PRIOR ART)
FIG. 2A is a diagram view of a conventional facemask having upper and lower head fastening ties.
Figure 2B:
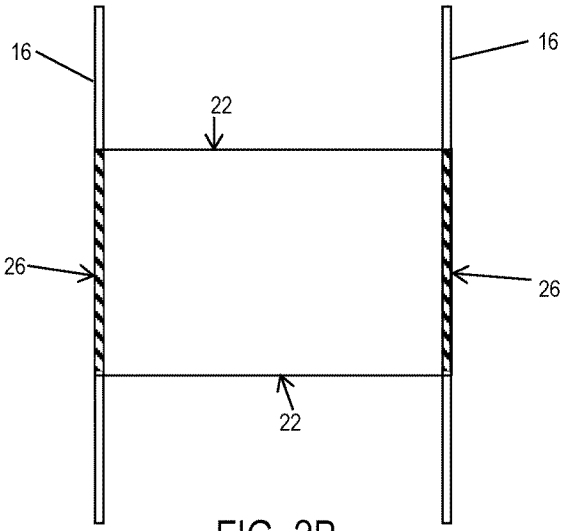
FIG. 2B (PRIOR ART)
FIG. 2B is a diagram view of another conventional facemask incorporating lateral fastening head fastening ties.

Referring to FIG. 1, a representative facemask 10 is illustrated on the face of wearer 12. The mask 10 includes a body 14 that is secured to the wearer 12 by means of various ties 16. Referring to FIG. 2A, the ties 16 may be continuous strips that are attached along the upper and lower edges 22 of the body 14. As a result, free portions 24 of the ties 16 may extend in a direction that is substantially parallel with the upper and lower edges 22. Referring to FIG. 2B, alternatively, the ties 16 may be continuous strips that are attached along the side edges 26 of the body 14. In such a configuration, free portions 26 of the ties 16 may extend in a direction that is substantially parallel with the side edges 26 of the body 14. When secured to the wearer 12 (illustrated in FIG. 1), the ties 16 are pulled tight (e.g., in respective "tension directions") around the neck and head of the wearer 12. With either of the above configurations, this causes the ties to be pulled at an angle with respect to the longitudinal direction resulting in stress concentrations where the ties 16 are attached to the body 14.

Figure 3A:
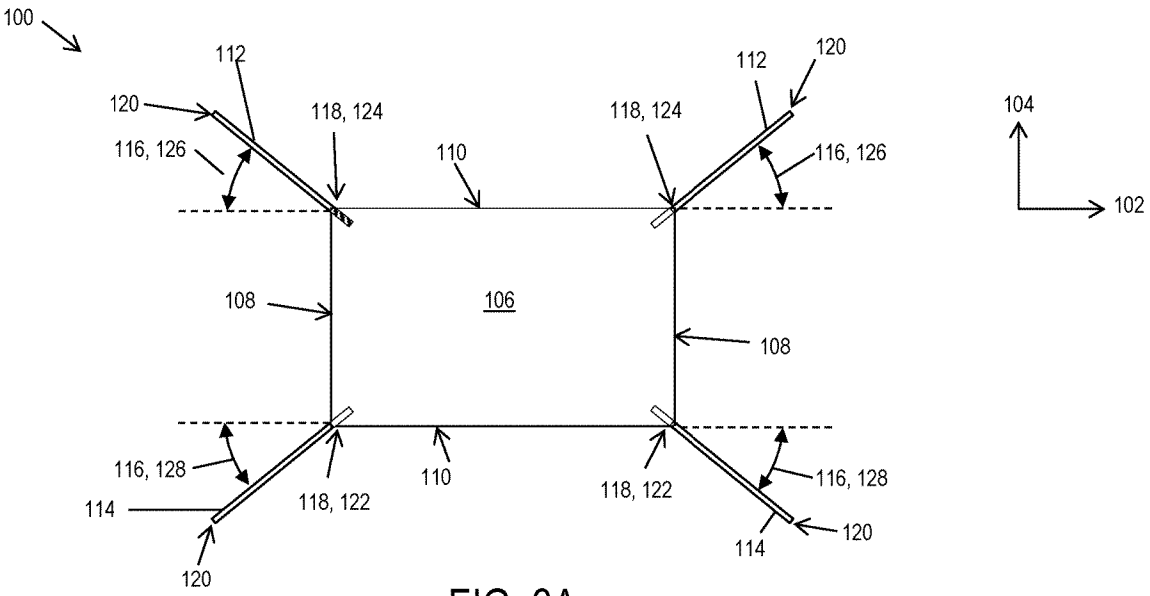
FIGS. 3A and 3B are diagram views of facemasks incorporating separate upper ties attached adjacent upper corners of the mask body of the facemask.

Referring to FIG. 3A, in accordance with aspects of the present disclosure, a facemask 100 is illustrated having a longitudinal direction 102 and a lateral direction 104 that is perpendicular to the longitudinal direction 102. The facemask 100 may include a mask body 106 having a generally rectangular shape. The facemask 100 may include a pair of lateral edges 108 extending in the lateral direction 104 and a pair of longitudinal edges 110 extending in the longitudinal direction 102. The facemask 100 may also include a pair of upper ties 112 and/or a pair of lower ties 114 attached to the mask body 106 and extending away from the mask body 106. The ties 112, 114 may extend away from the mask body 106 in directions that form respective angles 116 with the longitudinal direction. The angles 116 may range from about 10 degrees to about 80 degrees, in some embodiments from about 20 degrees to about 60 degrees, and in some embodiments from about 30 degrees to about 50 degrees, e.g., about 45 degrees.

This configuration may provide several advantages when compared with conventional facemask designs such as the designs illustrated in FIGS. 1A and 1B. For example, when a conventional mask to secured to the head of a wearer, stress concentrations are created where the ties attach to the body of the facemask. In accordance with aspects of the present disclosure, however, the ties 112, 114 may extend away from the mask body 106 in directions that reduce such stress concentrations. For example, the angles 116 may be selected such that the ties 112, 114 extend in directions approximately aligning with the respective directions in which the ties 112, 114 are pulled when the facemask 100 is worn. This may reduce the stress at the corners of the mask body 106 and/or in the ties 112, 114. Additionally, this may reduce distortion (e.g., folding or rippling) in the ties 112, 114 and/or mask body 106 caused by tension in the ties 112, 114.

In some embodiments, the pair of lower ties 114 may be separate from the pair of upper ties 112. Each of the ties 112, 114 may have an attached end 118 and a free end 120. The attached end 118 of each lower tie 114 may be attached to the mask body 106 adjacent a lower corner 122 of the mask body 106 at a lower tie angle 128, and the attached end 118 of each upper tie 112 may be attached to the mask body 106 adjacent an upper corner 124 of the mask body 106 at an upper tie angle 126. In an embodiment, the attached end 118 of each upper tie 112 may be attached to the mask body at a respective one of the pair of upper corners 124 such that the pair of upper ties 112 overlap adjacent sides of the rectangular shape of the mask body 106, The attached end 118 of each upper tie 112 may be attached to the mask body 106 at an upper tie angle 126 with the longitudinal direction 102. Each of the pair of upper ties 112 may extend away from the mask body 106 in a direction that forms an upper tie angle 126 with the longitudinal direction 102, and each of the pair of lower ties 114 may extend away from the mask body 106 in a direction that forms a lower tie angle 128 with the longitudinal direction 102. The upper and lower tie angles 126, 128 may range from about 10 degrees to about 80 degrees, in some embodiments from about 20 degrees to about 60 degrees, and in some embodiments from about 30 degrees to about 50 degrees, e.g., about 45 degrees.

The upper tie angles 126 may be equal to or different than the lower tie angles 128. Generally, however, the upper tie angles 126 may be equal to each other, and the lower tie angles may be equal to each other. However, in some embodiments, the lower ties 114 may have lower tie angles 128 that are different from each other; and the upper ties 112 may similarly have upper tie angles 126 that are different from each other.

In some embodiments, the upper and lower tie angles 126, 128 may be selected based on the angles that the ties are pulled during use. For example, the upper tie angle 126 may be selected to approximate the angle that the upper ties 112 will be pulled when tied behind a head of a wearer. Similarly, the lower tie angles 128 may be selected to approximate the angle that the lower ties 114 will be pulled tied behind a neck of the wearer.

Still referring to FIG. 3A, in some embodiments, lateral edges 108 and/or longitudinal edges 110 of the facemask 100 may be generally free from ties (e.g., upper and lower ties 112, 114). The lateral edges 108 may extend generally in the lateral direction 104 between one of the pair of upper corners 124 and one of the pair of lower corners 122. The pair of longitudinal edges 110 may extend generally in the longitudinal direction 102 between the pair of upper corners 124. The lateral edges 108 and/or longitudinal edges 110 may be free of ties 112, 114 along a substantial portion of their respective lengths. For example, one or more of the lateral edges 108 may be free of ties 112, 114 along a substantial portion of the length of the lateral edge 108. Similarly, one or more of the longitudinal edges 110 may be free of ties 112, 114 along a substantial portion of the length of the longitudinal edge 110. As used herein a "substantial portion" means at least 75% or more. For example, in some embodiments, a lateral edge 108 of the mask body 106 may be free of ties 112, 114 along 75% or more of a length of the lateral edge 108, in some embodiments 85% or more, in some embodiments 95% or more, in some embodiments 97% or more, and in some embodiments 99% or more, e.g., 100%. Similarly, in some embodiments, one or more of the longitudinal edges 110 may be free of ties along 75% or more of a length of the lateral edge 108, in some embodiments 85% or more, in some embodiments 95% or more, in some embodiments 97% or more, and in some embodiments 99% or more, e.g., 100%.

Figure 3B:
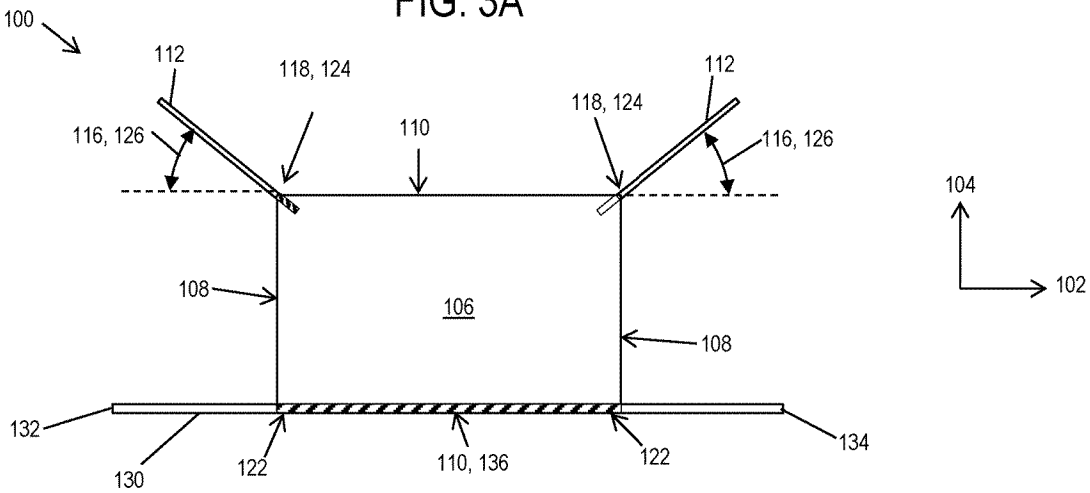

Referring to FIG. 3B, in some embodiments, the facemask 100 may include a single lower tie 130 having a first free end 132, a second free end 134, and a middle portion 136 between the first and second free ends 132, 134. The middle portion 136 may be attached along a lower longitudinal edge 110 of the mask body 106, such that unattached portions of the single lower tie 130 extend in the longitudinal direction 102 away from the mask body 106. This configuration may provide a combination of improved durability for the upper ties 112 and adjacent portions of the mask body 106 and additionally permit easy attachment of the single lower tie 130 to the mask body 106. The upper ties 112 may be configured in a similar manner as described with reference to FIG. 3A.

In an alternative embodiment, the facemask 100 may include a single upper tie and a pair of lower ties. In other words, the facemask may be configured such that the upper and lower ties 112, 114 are effectively vertically flipped with respect to the embodiment described with reference to FIG. 3B.

Figure 4A:
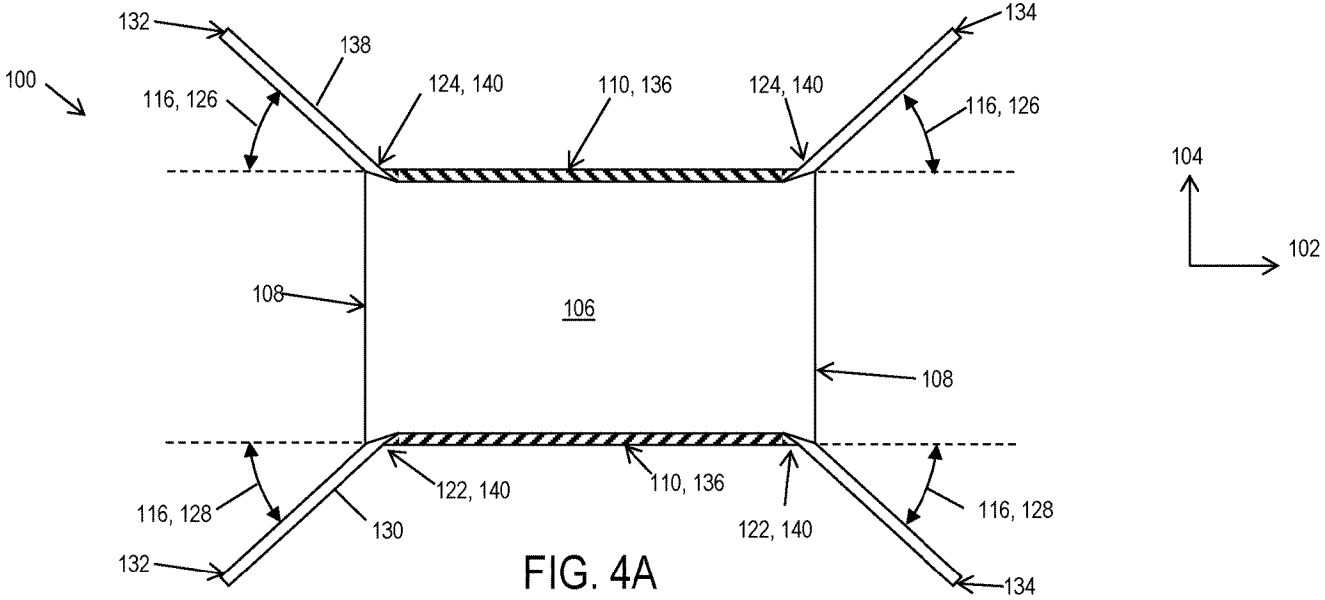
FIG. 4A is a diagram view of a facemask incorporating upper and lower ties attached along longitudinal edges of the mask body of the facemask.

Referring to FIG. 4A, in some embodiments, the facemask 100 may include a folded single upper tie 138. The folded single upper tie 138 may have a first free end 132, a second free end 134, and a middle portion 136 that is attached to the mask body 106. The middle portion 136 of the folded single upper tie 138 may be attached to the mask body 106 along the upper longitudinal edge 110 of the mask body 106. The folded single upper tie 138 may include a pair of folds 140 such that each of the free ends 132, 134 extends at a respective upper tie angle 126 with respect to the longitudinal direction 102. For example, the folded single upper tie 138 may be folded adjacent the upper corners 124 of the mask body 106. The single upper tie 138 may be attached to the mask body 106 using a variety of techniques as discussed herein. For example, the folded single upper tie 138 may be ultrasonically bonded to the mask body 106 along the upper longitudinal edge 110.

A folded single lower tie 130 may be similarly attached and folded. For example, the folded single lower 130 tie may be attached to the mask body 106 along a middle portion 136 of the single lower tie 130 that is between a first free end 132 and a second free end 134, in a similar manner as the folded single upper tie 138. The single lower tie 130 may include a pair of folds 140 such that each free end extends at a respective lower tie angle 128 with respect to the longitudinal direction 102.

In some embodiments, the folds 140 in the ties 130, 138 may be retained by additional bonding. For example, the folds 140 may include folded portions having an upper layer of fabric that overlays a lower layer of fabric. The upper layer of fabric may be attached (e.g., bonded) to the lower layer of fabric, which may help retain the fold 140. In other embodiments, however, the upper layer may not be attached to the lower layer.

Figure 4B:
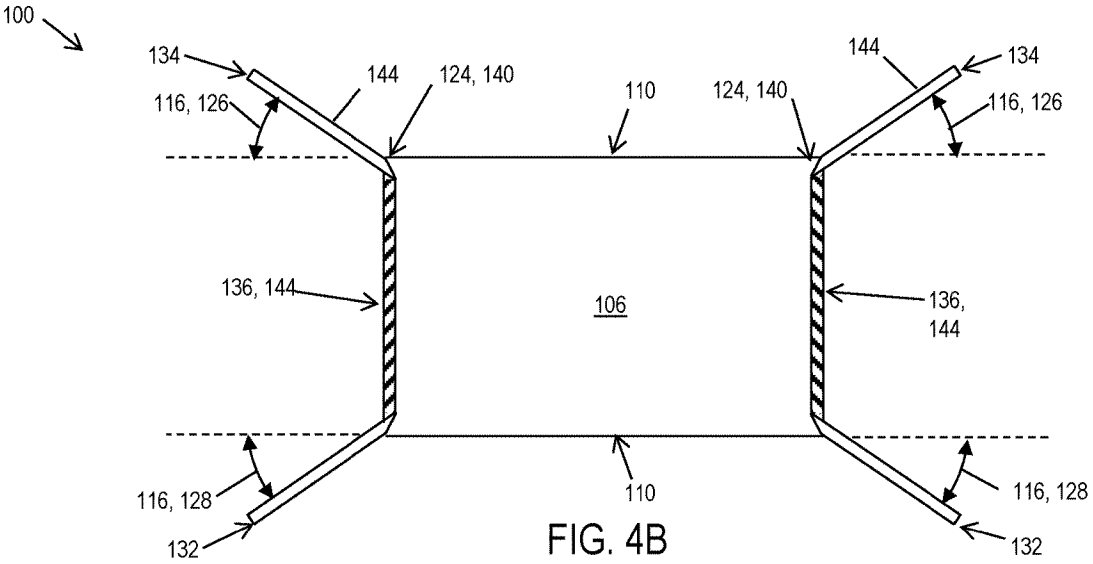
FIG. 4B is a diagram view of a facemask incorporating lateral ties attached along lateral edges of the mask body of the facemask.

Referring to FIG. 4B, in some embodiments, a pair of lateral ties 144 may be attached to the mask body 106 along the lateral edges 144 of the mask body 106. Each of the pair of lateral ties 144 may have a first free end 132, a second free end 134, and a middle portion 136 between the free ends 132, 134. The pair of lateral ties 144 may be attached to the mask body 106 along the middle portion 136 of each lateral tie 144. Each lateral tie 144 may include a fold 140 adjacent one of the corners 122, 124 of the mask body 106. Each of the first free end 132 and second free end 134 of the lateral tie 144 may extend away from the mask body 106 in respective directions that form respective tie angles 116 (e.g., lateral tie angles) with respect to the longitudinal direction 102. The lateral ties 144 may form both upper tie angles 126 and lower tie angles 128 with the longitudinal direction 102, which may be equal to or different than the upper tie angles 126, as discussed above.

Figure 4C:
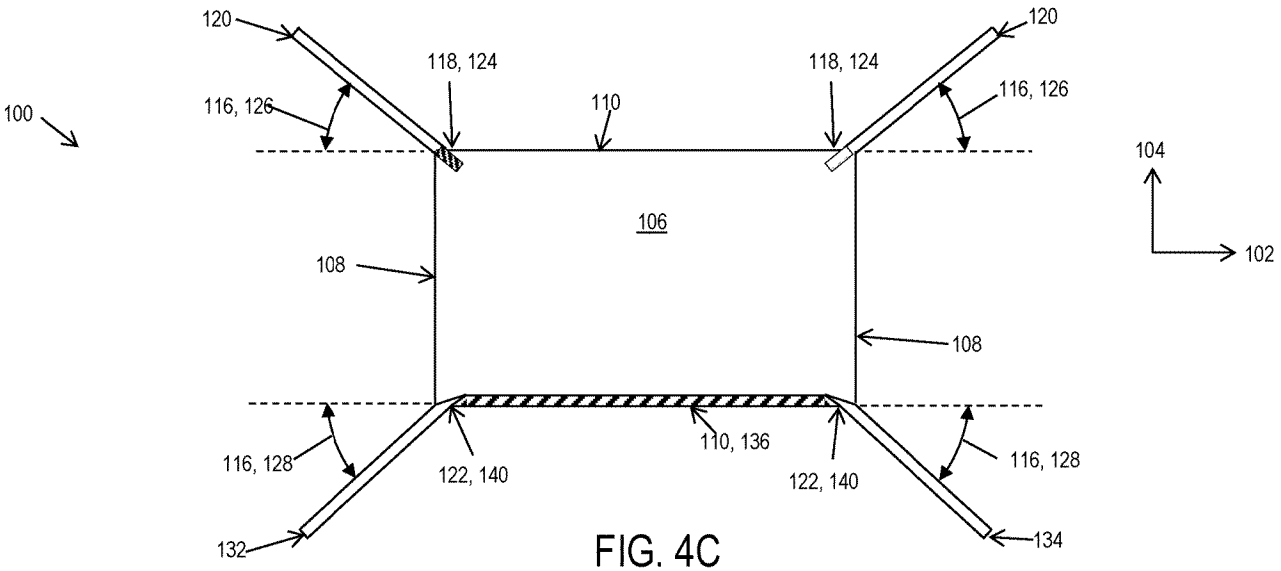
FIG. 4C is a diagram view of a facemask incorporating separate upper ties attached adjacent upper corners of the mask body and a lower tie attached along a lower longitudinal edge of the mask body of the facemask.

It should be understood that the above-described configurations may be combined in various ways to produce various additional embodiments. For example, referring to FIG. 4C, in some embodiments, a single lower tie 130 may be attached along a lower longitudinal edge 110 of the mask body 106, and a pair of separate upper ties 112 may be attached adjacent the upper corners 124 of the mask body 106, for example as described above with reference to FIG. 3A. The single lower tie 130 may include a pair of folds 140 such that the free ends 132, 134 of the single lower tie 130 extend in respective directions that each form lower tie angles 128 with the longitudinal direction 102. The upper ties 112 may be attached at upper tie angles 126 that are the same as or different than the lower tie angle 128. In other embodiments, a single upper tie may be attached along the upper longitudinal edge 110 of the mask body 106 and folded as described above, while a pair of separate lower ties 114 are attached adjacent the lower corners 122 of the mask body 106.

Figure 4D:
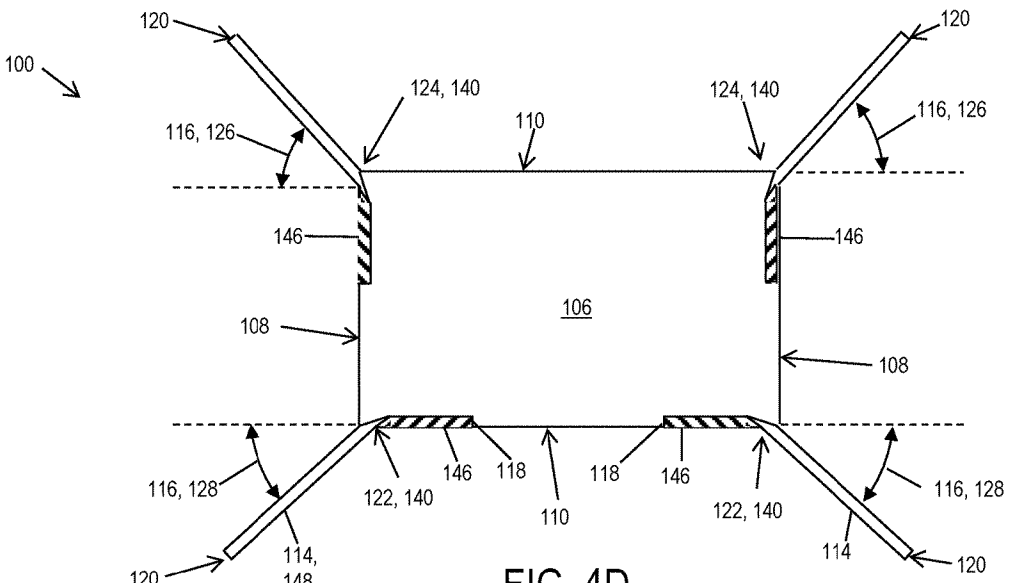
FIG. 4D is a diagram view of a facemask incorporating separate upper ties and separate lower ties attached along a significant portion of the lateral and longitudinal edges of the mask body of the facemask.

FIG. 4D illustrates another alternative embodiment of a facemask 100 in accordance with aspects of the present disclosure. In some embodiments, the facemask 100 may include a separate pair of upper ties 112 and a separate pair of lower ties 114. The ties 112, 114 may be attached along a significant portion of the longitudinal edges 110 and/or lateral edges 108 of the mask body 106. As used herein "significant portion" means at least 5% or more. For example, the pair of lower ties 114 may be attached along a 5% or less of the length of the longitudinal edge 110, in some embodiments 10% or less, and in some embodiments 25% or less. The pair of lower ties 114 may each include a fold 140 at the lower corners of the mask body 106. Each of the lower ties 114 may have an attached end 118 and a free end 120. An attached portion 146 may be defined from the lower corner 122 of the mask body 106 along the lateral edge 108 to the attached end 118 of the lower tie 114. The free end 120 of each lower tie 114 may extend away from a respective lower corner 122 of the mask body 106. A lower tie angle 128 may be formed between a free portion 148 of each lower tie 114 and the longitudinal direction 102.

The pair of upper ties 112 may be attached along respective portions of the lateral edges 108 and similarly have free ends 120, attached ends 118, and folds 140 at the upper corners 124. For example, the upper ties 112 may be attached along 5% or less of the length of the lateral edges 108, in some embodiments 10% or less, and in some embodiments 25% or less. Upper tie angles 126 may be formed between a free portion 148 of each upper tie 112 and the longitudinal direction 102. The upper and lower tie angles 126, 128 may be between 10 degrees and 80 degrees, as described above. It should be understood that the upper ties 112 may instead be attached along the longitudinal edge 110, and the lower ties 114 may instead be attached along the lateral edge 108. Yet other variations or combinations are possible within the scope of this disclosure.

Figure 5:
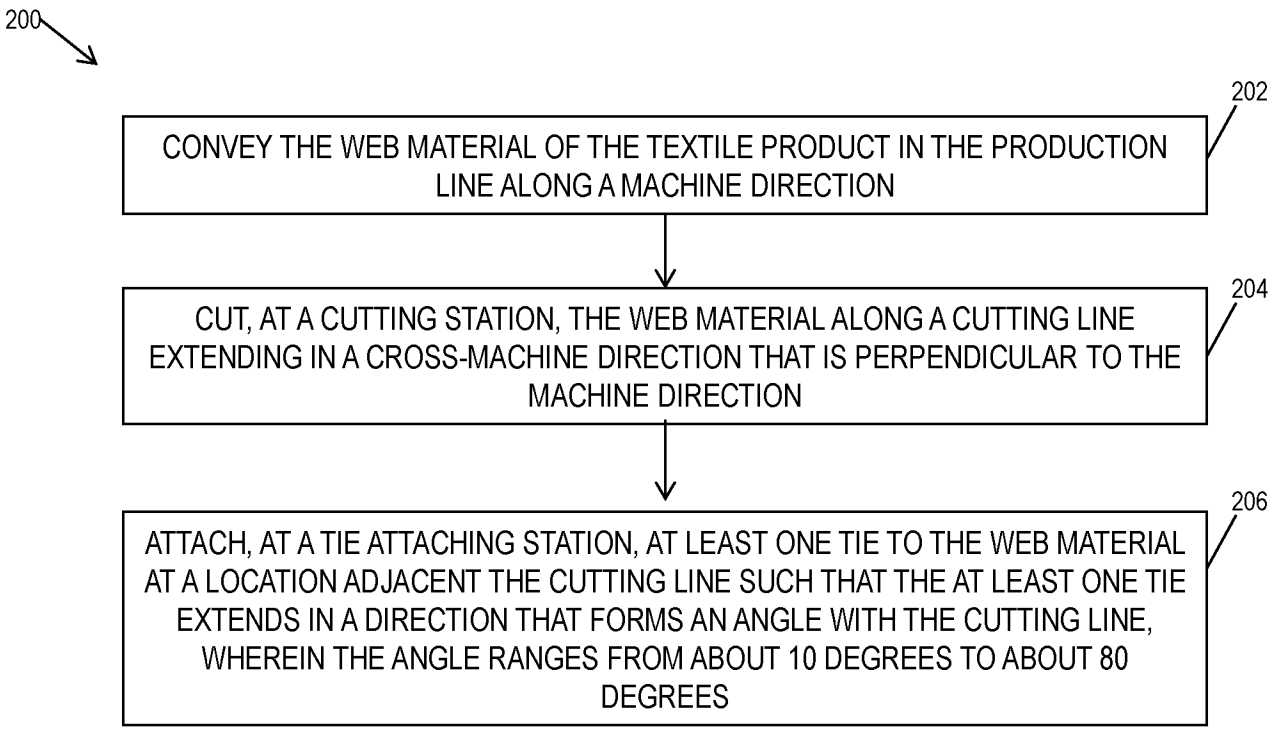
FIG. 5 is a flow diagram of method for manufacturing facemasks from a web material of a textile product in a production line.

FIG. 5 illustrates a flowchart of an automated method 200 for manufacturing facemasks from a web material of a textile product in a production line. Although described with reference to the embodiments described above, the automated method 200 is not limited to those embodiments. In addition, although FIG. 5 depicts steps performed in a particular order for purposes of illustration and discussion, the method 200 is not limited to any particular order or arrangement. One skilled in the art, using the disclosures provided herein, will appreciate that various steps of the method 200 can be omitted, rearranged, combined, and/or adapted in various ways without deviating from the scope of the present disclosure.

Referring to FIG. 5, the automated method 200 may include, at (202), conveying the web material of the textile product in the production line along a machine direction. The method 200 may include, at (204), cutting, at a cutting station, the web material along a cutting line extending in a cross-machine direction that is perpendicular to the machine direction. The method may include, at (206), attaching, at a tie attaching station, at least one tie to the web material at a location adjacent the cutting line such that the at least one tie extends in a direction that forms an angle with the cutting line, wherein the angle ranges from about 10 degrees to about 80 degrees.

In some embodiments, the cutting step, at (204), may be performed before the attaching step, at (206), as illustrated in FIG. 5. In other embodiments, however, the attaching step, at (206), may be performed before the cutting step, at (204), as explained in greater detail below.

In accordance with aspects of the present disclosure, a production line system may provide rapid production of distinct types of facemasks on a single production line. For example, the production line system may be capable of switching from one type of facemask to another type of facemask without requiring downtime to make adjustments (e.g., swap or adjust components) or to change settings of the production line system. For example, the production line system may be capable of producing, in alternation, combinations of the various types of facemask described herein. For instance, the production line system may be capable of producing in alternation facemasks having lateral ties and facemasks having upper and lower ties.

Figure 6B:
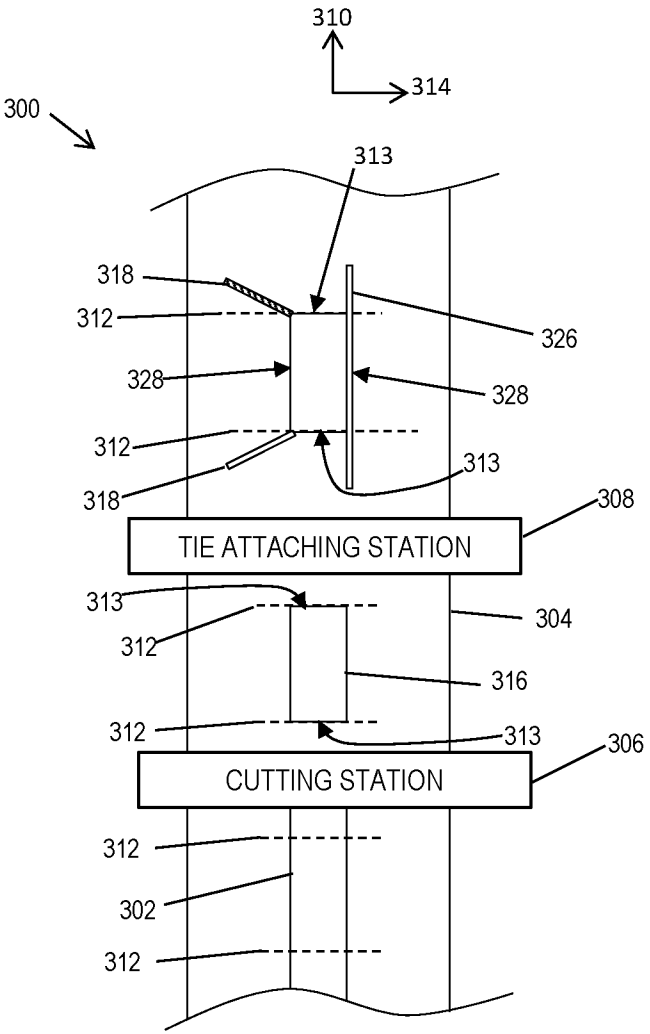
FIGS. 6A and 6B are top diagram views of portions of a facemask production line for forming facemasks having separate upper ties attached adjacent upper corners of the mask body in which a web material is cut before fastening ties are attached.
Figure 6A:
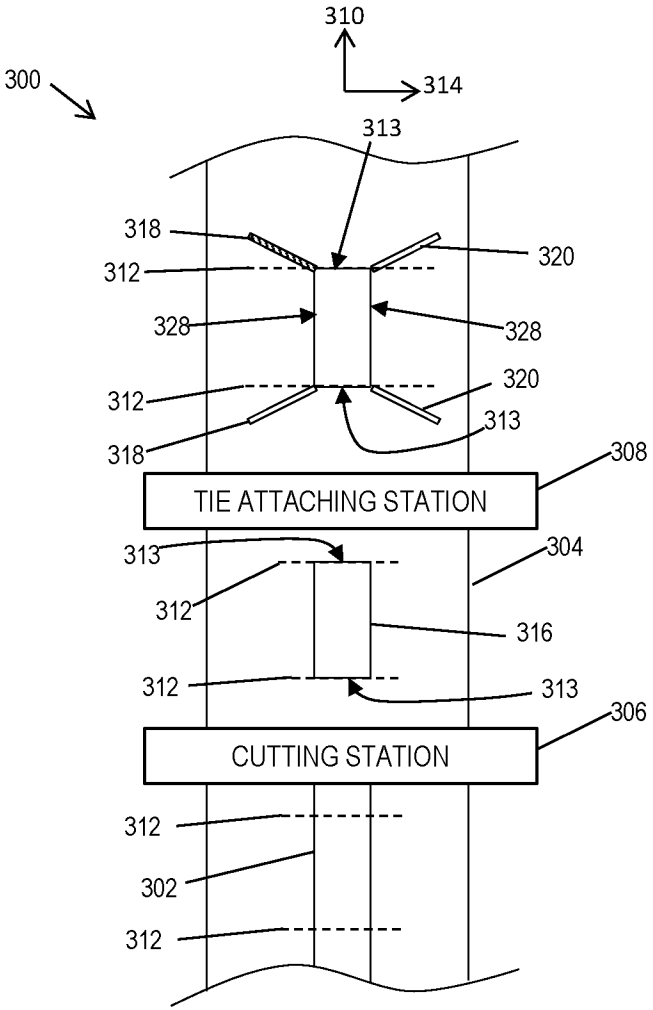

FIG. 6A illustrates a schematic production line system 300 according to aspects of the present disclosure. The production line system 300 may include a conveying apparatus. The conveying apparatus 300 may include any suitable mechanism for conveying a web material 302 of the textile product. For example, the conveying apparatus may include a plurality of rollers and/or a belt 304 that is driven by the rollers. The rollers may generally have a cylindrical shape, and the web 302 of the textile product may contact the rollers and/or belt 304. Alternatively the conveying apparatus may be any suitable manner of article conveyor, including, for example, vacuum conveyors.

The production line system 300 may also include a cutting station 306 and a tie attaching station 308. The conveying apparatus may convey a web material 302 in a machine direction 310 to the cutting station 306. The cutting station 306 may cut the web material 302 along a cutting line 312 extending in a cross-machine direction 314 that is perpendicular to the machine direction 310 to form lateral edges 313 of the mask body 316. As a result, the cutting station 306 may cut the web material 302 into a series of mask bodies 316.

The conveying apparatus may then convey the mask bodies 316 (cut from the web material 302) to the tie attaching station 308. The tie attaching station 308 may attach a pair of upper ties 318 and a pair of lower ties 320 to each mask body 316 to form an individual facemask 322. The tie attaching station 308 may attach the upper ties 318 at a location adjacent the cutting line 312 such that at least one upper tie 318 extends in a direction that forms an angle 324 with the cutting line 312 that ranges from about 10 degrees to about 80 degrees, in some embodiments from about 20 degrees to about 60 degrees, and in some embodiments from about 30 degrees to about 50 degrees, e.g., about 45 degrees. The lateral direction of the facemasks 322 may correspond with the cross-machine direction 314, and the longitudinal direction of the facemasks may correspond with the machine direction.

FIG. 6B illustrates another embodiment of the production line system 300 according to aspects of the present disclosure. The tie attaching station 308 may attach a pair of upper ties 318 as described above with reference to FIG. 6A. In this embodiment, the tie attaching station 308 may attach a single lower tie 326 to the mask body 316 along a longitudinal edge 328 of the mask body 316 instead of attaching a pair of lower ties 320 as described above.

Figure 7B:
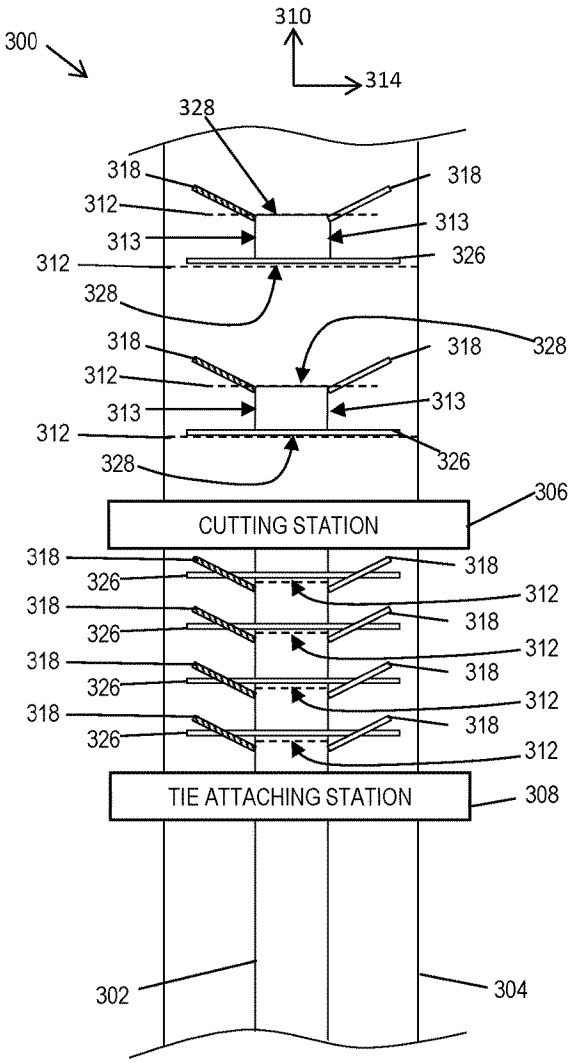
FIGS. 7A and 7B are top diagram views of portions of a facemask production line for forming facemasks having separate upper ties attached adjacent upper corners of the mask body in which fastening ties are attached before a web material is cut.
Figure 7A:
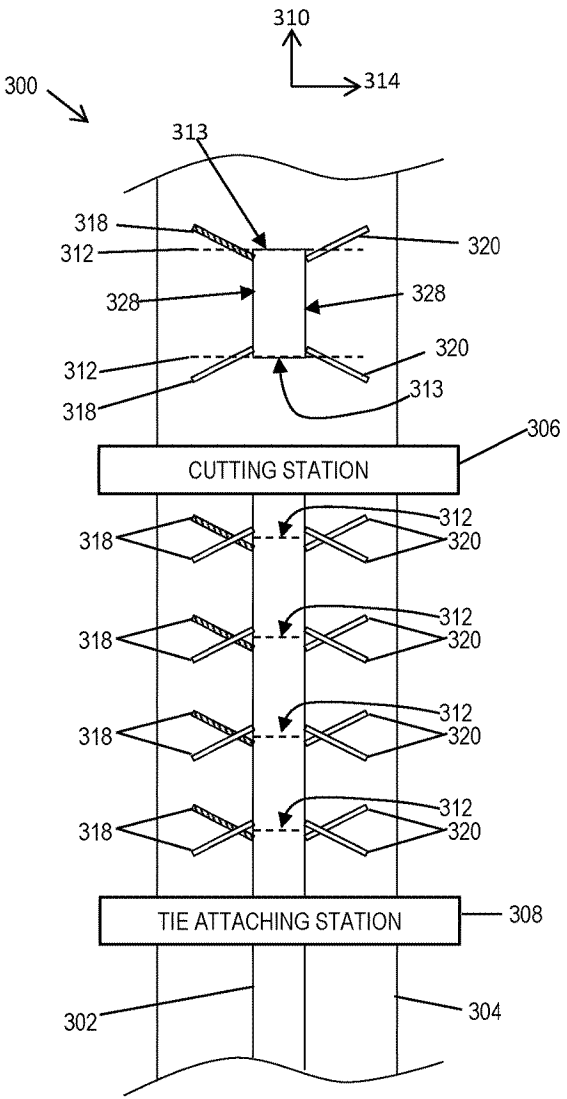

Referring to FIG. 7A, in some embodiments, the production line system 300 may be configured such that the web material 302 is conveyed to the tie attaching station 308 before being conveyed to the cutting station 306. For example, the conveying apparatus (e.g., belt 304) may convey the web material 302 to the tie attaching station 308. The tie attaching station 308 may attach a pair of upper ties 318 and a pair of lower ties to the web material 302 at a location adjacent a cutting line 312 such that at least one upper tie 318 extends in a direction that forms an angle with the cutting line 312 that ranges from about 10 degrees to about 80 degrees, in some embodiments from about 20 degrees to about 60 degrees, and in some embodiments from about 30 degrees to about 50 degrees, e.g., about 45 degrees. The conveying apparatus (e.g., belt 304) may then convey the web material 302, along with the attached ties 318, 320, to the cutting station 306. The cutting station 306 may cut the web material 302 along the cutting lines 312 to form individual facemasks 322.

Referring to FIG. 7B, in some embodiments, the production line system 300 may be configured to produce facemasks 322 having a single lower tie 326. In such embodiments, the web material 302 may have a width in the cross-machine direction 314 corresponding to a width of the mask body 316 of the finished facemask 322. The lateral direction of the facemasks 322 may correspond with the machine direction 310, and the longitudinal direction of the facemasks 322 may correspond with the cross-machine direction 314. The tie attaching station 308 may be configured to attach the single lower tie 326 to the mask body 316 such that the single lower tie 326 extends beyond each lateral edge 328 of the mask body 316. The tie attaching station 308 may also attach a pair of upper ties 318 having upper tie angles with respect to the cutting line 312. In this embodiment, the cutting lines 312 may generally extend parallel with the longitudinal direction of the facemask 322.

Figure 8B:
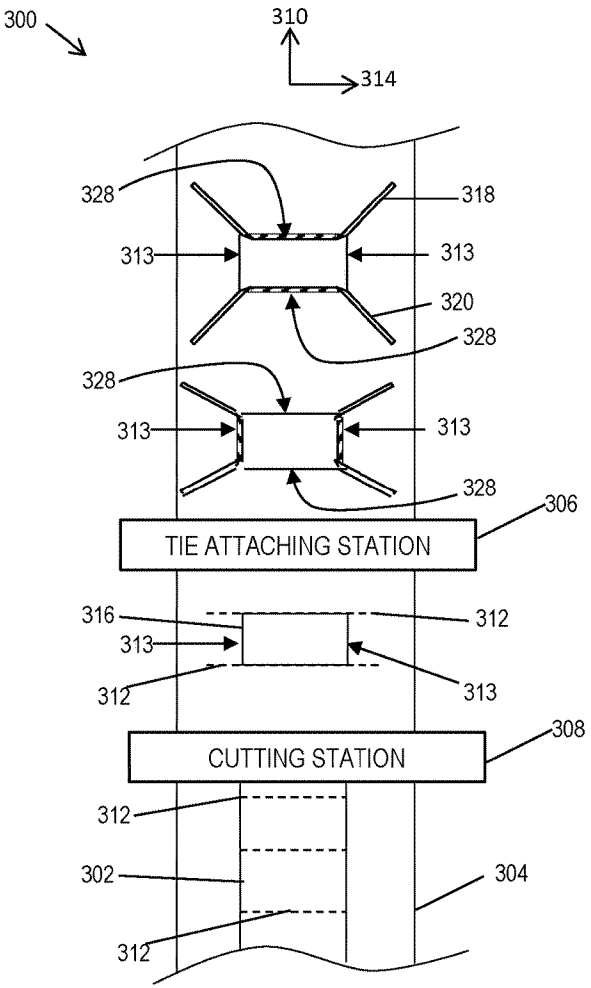
FIGS. 8A and 8B are top diagram views of portions of a facemask production line for forming facemasks having folded fastening ties in which a web material is cut before fastening ties are attached.
Figure 8A:
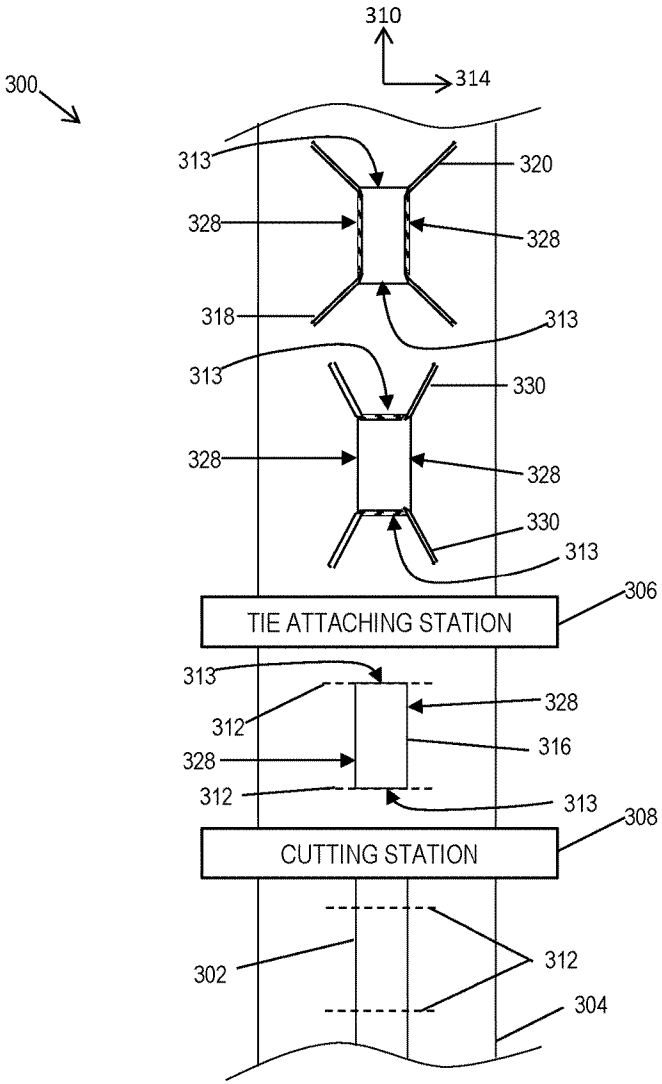

FIG. 8A illustrates another embodiment of the production line system 300 that is configured to cut the web 302 into mask bodies 316, attach ties, and fold the ties. The lateral direction of the facemasks 322 may generally correspond with the cross-machine direction 314, and the longitudinal direction of the facemasks may generally correspond with the machine direction 310. The cutting station 308 may cut the web 302 along cutting lines 312 that generally extend in the cross-machine direction 314 to form individual mask bodies 316. The tie attaching station 306 may then attach lateral ties 330 along the lateral edges 313 of the mask bodies 316 and fold the lateral ties 330 such that the lateral ties 330 form respective angles with the cutting line 313 that are between about 10 and about 80 degrees, for example as discussed above.

As indicated above, in some embodiments, the production line system 300 may be capable of producing multiple types of facemasks. For example, referring to FIG. 8A, the tie attaching station 306 may also be configured to attach and fold upper ties 318 and lower ties 320. The tie attaching station 306 may be capable of attaching ties 318, 320 in either configuration e.g., in alternation, without delay between switching between configurations.

FIG. 8B illustrates another embodiment of the production line system 300 in which the lateral edges 313 of the facemasks 322 may generally extend in the machine direction 310, and the longitudinal edges 328 of the facemasks 322 may generally extend in the cross-machine direction 314. The cutting station 308 may cut the web 302 along cutting lines 312 that generally extend in the cross-machine direction 314. The tie attaching station 306 may then attach and/or fold the ties (e.g., lateral ties 330 or upper ties 318 and lower ties 320) in a similar manner as described above. Similarly, the tie attaching station 306 may be configured to produce any of the configurations of facemasks 322 described herein without requiring downtime and/or adjustment (e.g., in alternation). For example, as illustrated in FIG. 8B, facemasks 322 having lateral ties 330 may be produced on the same production line (e.g., in alternation) as facemasks having upper ties 318 and lower ties 320.

Figure 9B:
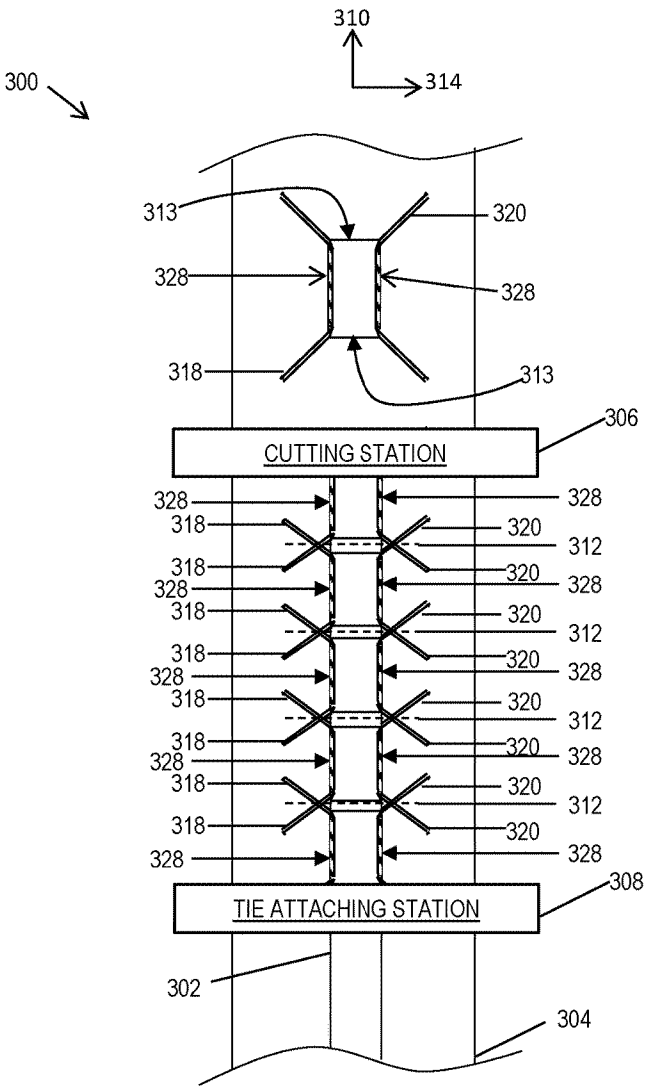
FIGS. 9A through 10B are top diagram views of portions of a facemask production line for forming facemasks having folded fastening ties in which fastening ties are attached before a web material is cut.
Figure 9A:
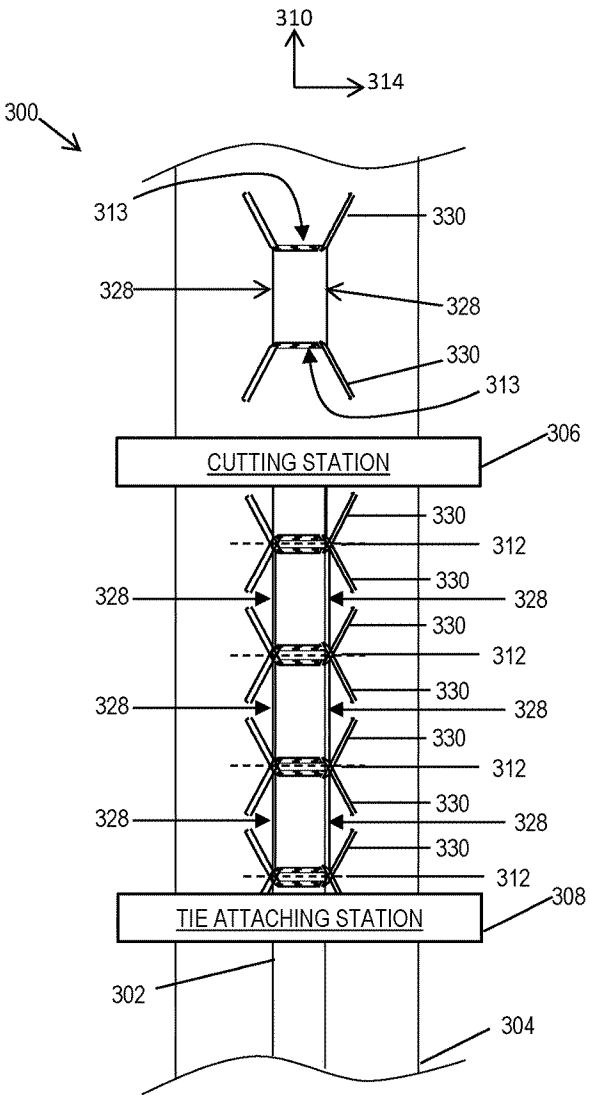

Referring to FIG. 9A, in some embodiments, the tie attaching station 308 may be configured to attach and fold ties before the cutting station cuts 306 the web 302 to form separate facemasks 322. For example, the tie attaching station may be configured to attach lateral ties 300. The cutting station 306 may then cut the web along the cutting lines 312, which may generally extend in the cross-machine direction 314. Although the cutting lines 314 are illustrated as intersecting the lateral ties 330, it should be understood that the cutting station 306 generally does not cut the ties 330.

In some embodiments, the ties 330 may be folded after the cutting station 306 cuts the ties 330. For example, the tie attaching station 308 may attach the lateral ties 330 but leave the lateral ties 330 unfolded such that the lateral ties 330 generally extend in the cross-machine direction 314. This may allow the cutting station 306 to more easily cut the web 302 without the lateral ties 330 interfering. A folding station may be configured to then fold the lateral ties 330.

Referring to FIG. 9B, in some embodiments, the tie attaching station 308 may be configured to attach upper ties 318 and lower ties 320 to the web 302. The cutting station 306 may cut the web 302 along cutting lines 312 which generally extend in the cross-machine direction 314. This may form individual facemasks 322 having upper ties 318 and lower ties 320 attached to the longitudinal edges 328 of the mask bodies 316 of the individual facemasks 322.

Figure 10B:
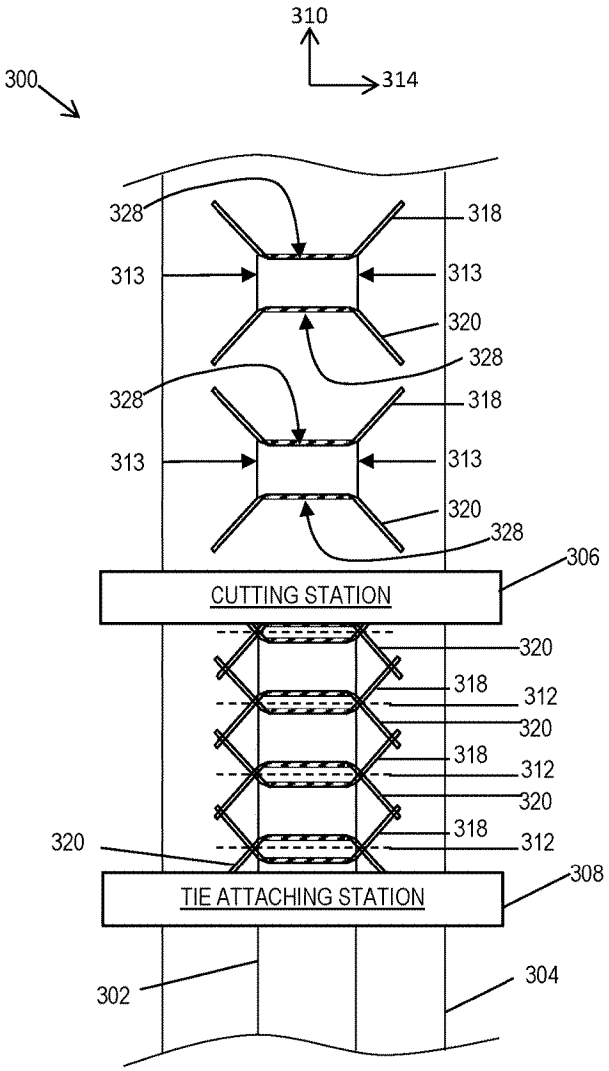
Figure 10A:
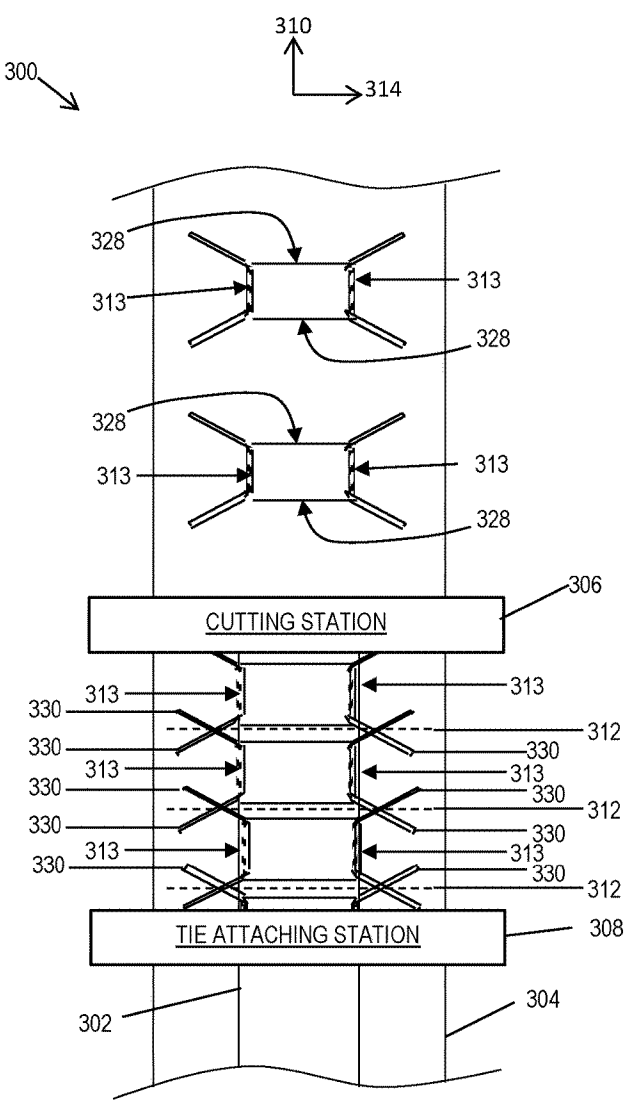

Referring to FIGS. 10A and 10B, in some embodiments, the cross-machine direction 314 may generally correspond with the longitudinal direction of the finished facemasks 322, and the machine direction 310 may generally correspond with the lateral direction of the finished facemasks 310. FIG. 10A illustrates an embodiment of the production line system 300 in which the tie attaching station 308 attaches lateral ties 330 to the lateral edges 313 of the web 302. The cutting station 306 may then cut the web 302 along the cutting lines 312 (corresponding to the longitudinal edges of the facemasks 322) to form the separate facemasks 322.

FIG. 10B illustrates an embodiment of the production line system 300 in which the tie attaching station 308 attaches upper ties 318 and lower ties 320 to the web 302 on each side of each cutting line 312. The tie attaching station 308 may also fold the upper and lower ties 318, 320. The cutting station 306 may then cut the web 302 along the cutting lines 312 (corresponding to the longitudinal edges of the facemasks 322) to form separate facemasks 322 having upper ties 318 and lower ties 320 attached to the longitudinal edges of the facemasks 322.

In some embodiments, the tie attaching station 308 may not fold the upper and lower ties 318, 320. Instead, the tie attaching station 308 may attach the upper and lower ties 318, 320 and leave the upper and lower ties 318, 320 unfolded such that the upper and lower ties 318, 320 extend generally in the cross-machine direction 314. This may allow the cutting station 306 to more easily cut the web 302 along the cutting lines 312. Next, a folding station may fold the upper and lower ties 318, 320 such that the upper and lower ties 318, 320 form respective angles with the cutting lines 312 between about 10 degrees and about 90 degrees, for example as described above.

The ties may be attached to the web using a variety of suitable techniques. For example, such techniques may include stitching, adhesives, and/or thermal bonding. For instance, in some embodiments, ultrasonic bonding may be used. Any suitable technique may be used, however.

The tie attaching station 302 may include a variety of suitable apparatuses for attaching and/or folding the ties. For example, a robotic or actuated arm may be configured to arrange and/or fold the ties as required. Additionally, in some embodiments, the tie attaching station 302 may be configured to fold the ties before attaching them, while in other embodiments, the tie attaching station 302 may be configured to attach the ties before folding them. As indicated above, in other embodiments, a separate tie folding station may be configured to fold the ties. In some embodiments, the folding station may fold the ties before the tie attaching station attaches the ties. In other embodiments, the folding station may be configured to fold the ties after the tie attaching station 30 attaches the ties and/or after the cutting station 306 cuts the web 302 to form separate facemasks 322. In some embodiments, the tie attaching station 302 and/or folding station may be further configured to secure the folds using a variety of methods, including for example, stitching, ultrasonic bonding, etc.

One of ordinary skill in the art would understand that yet further combinations of the various embodiments described herein are possible and within the scope of this disclosure.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A facemask having a longitudinal direction and a lateral direction that is perpendicular to the longitudinal direction, the facemask comprising:

a mask body having a generally rectangular shape, a pair of lateral edges extending in the lateral direction, a pair of upper corners, a pair of longitudinal edges extending in the longitudinal direction, and a pair of lower corners, wherein the mask body is formed from a nonwoven web;

a pair of upper ties attached to the mask body at an upper tie angle relative to the longitudinal direction and extending away from the mask body in a direction of the upper tie angle with the longitudinal direction, wherein the pair of upper ties includes a first upper tie and a second upper tie each having an attached end and a free end, the attached end of both the first upper tie and the second upper tie being attached to the mask body at the upper tie angle relative to the longitudinal direction on a respective one of the pair of upper corners such that the pair of upper ties overlap adjacent sides of the rectangular shape of the mask body, wherein each of the pair of upper corners comprise a respective one of the pair of lateral edges a respective one of the pair of longitudinal edges, wherein the attached end extends at the upper tie angle; and a pair of lower ties attached to the mask body and extending away from the mask body in a direction that forms a lower tie angle extending downward with the longitudinal direction, wherein the pair of lower ties includes a first lower tie and a second lower tie each having an attached end and a free end, the attached end of both the first lower tie and the second lower tie being attached to the mask body at the lower tie angle relative to the longitudinal direction on a respective one of the pair of lower corners such that the pair of lower ties overlap adjacent sides of the rectangular shape of the mask body, wherein the pair of lateral edges are free of any ties along a substantial portion of a length of the lateral edges, and wherein the upper tie angle is different from the lower tie angle, wherein the upper tie angle ranges from 10 degrees to 80 degrees in relation to the longitudinal direction.

2. The facemask of claim 1, wherein the pair of longitudinal edges are free of any ties along a substantial portion of a length of the longitudinal edges.

3. The facemask of claim 2, wherein the pair of longitudinal edges are free of any ties along at least 95% of the length of the longitudinal edges.

4. The facemask of claim 1, wherein the lower tie angle ranges from 10 degrees to 80 degrees in relation to the longitudinal direction.

5. The facemask of claim 1, wherein the pair of upper ties, the pair of lower ties, or both pairs are ultrasonically bonded to the mask body.

6. The facemask of claim 1, wherein the attached end of each the first upper tie and the second upper tie intersects the respective one of the pair of upper corners at the upper tie angle.

7. The facemask of claim 1, wherein the upper tie angle extends relative to the longitudinal direction in a tension direction along which the respective pair of upper ties are pulled when worn.

8. The facemask of claim 1, wherein the lower tie angle extends relative to the longitudinal direction in a tension direction along which the respective pair of lower ties are pulled when worn.

9. The facemask of claim 1, wherein the nonwoven web comprises polypropylene, polyethylene, polyester, or a combination thereof.

10. The facemask of claim 9, wherein the nonwoven web comprises fiber-grade spunbond polypropylene (SPBB), fiber-grade melt-blown polypropylene (MBPP), low density polyethylene (LDPE), or a combination thereof.

11. The facemask of claim 1, wherein the pair of lateral edges are free of any ties along at least 95% of the length of the lateral edges.

* * * * *